US007908811B2

(12) United States Patent
Ubilla

(10) Patent No.: US 7,908,811 B2
(45) Date of Patent: Mar. 22, 2011

(54) CONSTRUCTION ELEMENT

(76) Inventor: Jose Rojas Ubilla, Santiago (CL)

( * ) Notice: Subject to any disclaimer, the term of this patent is extended or adjusted under 35 U.S.C. 154(b) by 1146 days.

(21) Appl. No.: 11/504,889

(22) Filed: Aug. 16, 2006

(65) Prior Publication Data

US 2007/0044425 A1 Mar. 1, 2007

(51) Int. Cl.
*E04C 2/34* (2006.01)

(52) U.S. Cl. ..... 52/481.1; 52/831; 52/836; 52/842; 52/846

(58) Field of Classification Search ..... 52/481.1, 52/831, 836, 842, 846
See application file for complete search history.

(56) References Cited

U.S. PATENT DOCUMENTS

| | | | | | |
|---|---|---|---|---|---|
| 2,844,848 | A * | 7/1958 | Couse et al. | 52/309.11 |
| 3,034,197 | A | 5/1962 | Watanabe | |
| 3,283,464 | A * | 11/1966 | Franz | 52/636 |
| 3,812,558 | A | 5/1974 | Watanabe | |
| 3,874,051 | A * | 4/1975 | Malik | 29/897.31 |
| 4,152,873 | A * | 5/1979 | Burke | 52/1 |
| 4,545,170 | A * | 10/1985 | Shirey | 52/670 |
| 4,894,898 | A * | 1/1990 | Walker | 29/897.35 |
| 5,524,410 | A * | 6/1996 | Menchetti | 52/838 |
| 5,661,881 | A * | 9/1997 | Menchetti | 29/6.1 |
| 6,109,329 | A * | 8/2000 | Russo | 160/135 |
| 6,205,740 | B1 * | 3/2001 | Ekerholm et al. | 52/846 |
| 6,381,916 | B1 * | 5/2002 | Maisch et al. | 52/846 |
| 6,453,973 | B1 * | 9/2002 | Russo | 160/135 |
| 6,641,219 | B2 * | 11/2003 | Meshke et al. | 297/391 |
| 2004/0093822 | A1 | 5/2004 | Anderson | |

FOREIGN PATENT DOCUMENTS

| | | |
|---|---|---|
| GB | 10484 | 7/1916 |

* cited by examiner

*Primary Examiner* — Brian E Glessner
*Assistant Examiner* — James J Buckle, Jr.
(74) *Attorney, Agent, or Firm* — Fulbright & Jaworski LLP

(57) ABSTRACT

Constructive element (1), such as a profile or a grid or another adequate constructive element, where said constructive element (1) is formed beginning with a sheet whose thickness is fundamentally constant; the cross-section of said constructive element includes at least one unfolded region (2) defined between two ends of said cross-section; said unfolded region (2) includes a plurality of cuts that define a regular pattern along the constructive element (1); said unfolded region (2) is produced when a tractional force is applied to their respective ends; said constructive element (1) is characterized because said unfolded region includes at least one element rotated essentially in 180° (2.2) with regard to the rotation it had prior to the application of said tractional force; said at least one rotated element (2.2) is joined to at least one element that does not rotate (2.1), by means of conveniently defined linking lines (2.3).

14 Claims, 5 Drawing Sheets

CONSTRUCTION ELEMENT

CROSS-REFERENCE TO RELATED APPLICATIONS

This application claims priority to Chilean Patent Application No. 2254-2005 filed on Sep. 1, 2005.

BACKGROUND OF THE INVENTION

This invention corresponds to a constructive element to be used in habitable or non-habitable buildings where said constructive element includes al least one unfolded region.

The utilization of constructive elements such as steel profiles is a practice widely used in the erection of habitable or non-habitable buildings. Due to the large-scale utilization of this type of elements, more efficient configurations are continuously being required that must be capable of adequately satisfying the requirements of the project as well as having more competitive costs. Among the requirements, we can mention: structural resistance, durability, good aesthetic appearance, manufacture, simple, rapid and economic transport and installation.

One of the applications for this type of profile is associated to structural walls, which, typically, have a framework made of a plurality of profiles. This framework defines two faces on which a layer of finishing material and/or insulation such as plaster-cardboard, fiber-cement or wood is placed.

The type of profile that is used traditionally to make structural walls, such as those mentioned in the previous paragraph, is one whose cross-section is essentially U-shaped, that includes a core and two wings that extend from said core and finish in two respective free ends. Additionally, in order to improve the structural performance of said profiles, the free ends of the wings are normally reinforced with two stiffener flanges that spread out, coming closer to each other, from the free ends of said wings.

When making the structural walls that use these profiles, the mentioned layers of finishing material and/or insulation are joined respectively to each one of the wings of each one of the profiles of said framework.

Among the numerous production processes that are used to make this type of profile, cold-rolling is the one most used because it permits the manufacture of the mentioned profiles at very competitive costs. The cold-rolling process permits the manufacture of profiles from a metal sheet having a constant thickness; therefore the resulting profiles also have a constant thickness.

When cold-rolling is used for profiles with geometries similar to a "U" with stiffened wings, such as those described above, a technical problem arises because one, the core of said profiles has the same thickness as the wings and second, said core is subject to significantly lower stress than said wings, which is why the core is over-dimensioned; therefore the said profile occupies an unnecessarily high amount of steel in its core.

This technical problem is associated not only to profiles but also to other constructive elements that, in general, have a constant thickness and have parts that are subject to significantly lower stresses than others.

Based on the above, it is evident that inventions are needed that permit the manufacture of profiles and other related constructive elements and that are able to solve the technical problem indicated in the previous paragraph.

BRIEF SUMMARY OF THE INVENTION

This invention corresponds to a structural or non structural element, such as a profile, a grid or another adequate element, to be used in habitable or non habitable buildings, that overcomes the above-mentioned technical problem.

In the first modality, the invention corresponds to a structural or non structural profile (1) with a cross-section that is essentially constant, that is formed based on a sheet whose thickness is fundamentally constant; the cross-section of said structural or non structural profile (1) includes at least one unfolded region (2) defined between two ends of said cross-section; said unfolded section (2) includes a plurality of cuts that define a regular pattern through the entire length of the structural or non structural profile (1); said unfolded region (2) occurs when tractional force is applied at the respective ends; said structural or non structural profile (1) is characterized because said unfolded region comprises at least one element rotated essentially in 180° (2.2) with regard to the rotation it had prior to the application of said tractional force; said at least one rotated element (2.2) is joined to at least one element that does not rotate (2.1) by means of conveniently defined linking lines (2.3). Said at least one rotated element (2.2) and said at least one non rotating element (2.1) have, first, respective zones that are in an overlapping relationship with one another, and secondly, respective zones that are not in an overlapping relationship with one another. The parts of said at least one rotated element (2.2) and of said at least one non rotating element (2.1) that are not overlapping each other are essentially coplanar. Said at least one rotated element (2.2) and/or said at least one non rotating element (2.1) have zones with essentially closed curves (2.4) that connect their respective overlapping zones with their respective non overlapping zones.

The invention vindicated permits a simple and relatively inexpensive solution to the above-mentioned technical problem, because the mentioned unfolding permits saving material in the parts of the profile that are submitted to less mechanical stress, without prejudice to its structural performance. Furthermore, its production costs are very competitive because industrialized production processes can be involved such as cold-rolling, press stamping and unfolding.

The existence of the above-mentioned essentially closed curves (2.4) is fundamental if the profile of the invention is to have an outstanding structural performance. In effect, the geometry defined by said essentially closed curves (2.4) allows a mutual interlocking to take place in the unfolded region of the profile between said at least one rotated element (2.2) and said at least one non rotating element (2.1), which greatly increases the resistance to deformation in the unfolded region of the profile of the invention.

The utilization of elements rotated in 180° (2.2) in the unfolded region (2), conveniently influences the production of hardened regions (2.3) by cold deformation, which conveniently improve the characteristics of the profile.

Each one of those cuts, of said plurality of cuts, can essentially have the geometry of a "U" that comprises a base (a) and two sides (b), each one of which comprises a basal end, joined to said base (a), and a free end separated from said base; said plurality of cuts comprises two rows of cuts, each one of which is formed by a multiplicity of cuts placed one following the other in an adjacent manner; the bases (a) of each one of the cuts of each one of said rows of cuts are aligned; the free ends of the adjacent sides (b) of each pair of adjacent cuts of one of the rows of cuts are set out conveniently between the sides of a respective cut of the other row of cuts.

This modality of the invention unites a good structural performance in the unfolding with the involvement of a good aesthetical appearance.

Each one of these bases (a) can be essentially rectilinear and each one of said sides (b) can be essentially rectilinear and form an essentially right angle with the respective base (a) to which it is united.

The intersection between each one of said bases (a) and each one of said sides (b) can be essentially curved. As a result of this the unfolded profile of the invention has no sharp edges, which protects the workers while they are manipulating the unfolded profile of the invention.

Said structural or non structural profile (1) can include a cross-section essentially in the shape of a "U" that comprises a core that coincides with said unfolded region (2), and two wings (3) that extend outward from said core and finish in two respective free ends.

Said structural or non structural profile (1) can include two stiffener flanges (4) that spread out, coming closer to each other, from the free ends of said wings (3).

The profile of the invention can be used in the manufacture of panels, of the type that consist of a framework made with a plurality of said profiles, where said framework defines two faces, and a layer of finishing materials and/or insulation is fixed to each of said two faces.

In order to optimize the thermal insulation and the resistance to mechanical stress of the panel that can be built with said profile, the profile's geometry has been submitted to a complex and systematized combined optimization process. Said combined optimization process was based on the use of two specialized "softwares" that permitted the combined optimization of the acoustic performance and the structural performance of the panel that uses the profile.

The following relevant dimensions of the profile were involved in said optimization process:

i. First dimension (D1), corresponding to the width of the unfolded region of the profile when it is in a folded state.

ii. Second dimension (D2), corresponding to the distance between the bases (a) of the cuts of said two rows of cuts, when the profile is not unfolded.

iii. Third dimension (D3), corresponding to the distance between the linkage lines (2.3) associated to the cuts of said two rows of cuts, when the profile is not unfolded.

iv. Fourth dimension (D4), corresponding to the radius of curvature associated to the curve that is produced in the intersection between each one of said bases (a) and each one of said sides (b).

v. Fifth dimension (D5), corresponding to the distance between the sides (b) of each one of said cuts.

vi. Sixth dimension (D6), corresponding to the distance between two sides (b) adjacent to the two consecutive cuts of one of said rows of cuts.

vii. Seventh dimension (D7), corresponding to the width of the profile, when the profile is folded.

viii. Eighth dimension (D8), corresponding to the thickness of the sheet with which the profile is made.

The optimum values found for the profile of the invention correspond approximately to the following:

i. First dimension (D1)=28 mm.

ii. Second dimension (D2)=12.5 mm iii. Third dimension (D3)=5.5 mm iv. Fourth dimension (D4)=3 mm v. Fifth dimension (D5)=28 mm vi. Sixth dimension (D6)=12 mm vii. Seventh dimension (D7)=110 mm viii. Eighth dimension (D8)=0.5 mm The optimized profile of the invention makes very efficient use of the material making it particularly light, involving very advantageous production costs with regard to the profiles that exist in the prior art.

Additionally, this optimized profile satisfies, in a very efficient manner, the mechanical stress to which it is subjected to when used in the manufacture of panels such as those described above.

On the other hand, due to the sound deadening characteristics of the optimized profile of the invention, the panels that are made with it can achieve high standards of acoustic insulation using thinner layers of finishing and/or insulating material, when compared with the panels that are made with the profiles of the prior art. This permits a considerable saving in costs in the manufacture of panels that use the profile of the invention.

A stamping press can generate each one of said cuts. This modality of the invention involves very competitive costs.

Said sheet can correspond to a metal sheet, preferably steel. Additionally, said sheet could be manufactured from plastic materials, compounds, etc.

In a second modality, the invention corresponds to a constructive element (1), such as a profile or a grid or another adequate constructive element, where said constructive element (1) is formed starting with a sheet whose thickness is fundamentally constant; the cross-section of said constructive element (1) comprises at least one unfolded region (2) defined between two ends of said cross-section; said unfolded region (2) comprises a plurality of cuts that define a regular pattern along the constructive element (1); said unfolded region (2) is produced when a tractional force is applied at its respective ends; said constructive element being characterized because said unfolded region comprises at least one element rotated essentially in 180° (2.2) with regard to the rotation it had prior to the application of said tractional force; said at least one rotated element (2.2) is joined to at least one element that does not rotate (2.1), by means of conveniently defined linking lines (2.3).

The invention vindicated permits a simple and essentially low cost solution to the above-mentioned technical problem, because the mentioned unfolding permits a saving of steel in the parts of the constructive element that are submitted to less mechanical stress, without harming its structural performance; furthermore, its production costs are very competitive because industrialized production processes can be involved such as cold-rolling, press stamping and unfolding.

The utilization of elements rotated in 180° (2.2) in the unfolded region (2), conveniently influences the production of regions (2.3) hardened by cold deformation, which conveniently improve the characteristics of the profile.

Each one of those cuts, of said plurality of cuts, can essentially have the geometry of a "U" that comprises a base (a) and two sides (b), each one of which comprises a basal end, joined to said base (a), and a free end separated from said base; said plurality of cuts comprises two rows of cuts, each one of which is formed by a multiplicity of cuts placed one following the other in an adjacent manner; the bases (a) of each one of the cuts of each one of said rows of cuts are aligned; the free ends of the adjacent sides (b) of each pair of adjacent cuts of one of the rows of cuts are set out conveniently between the sides of a respective cut of the other row of cuts.

This modality of the invention unites a good structural performance in the unfolding with the involvement of a good aesthetical appearance.

Each one of these bases (a) can be essentially rectilinear and each one of said sides (b) can be essentially rectilinear and form an essentially right angle with the respective base (a) to which it is united.

The intersection between each one of said bases (a) and each one of said sides (b) can be essentially curved. As a result of this the unfolded profile of the invention has no sharp edges, which protects the workers while they are manipulating the unfolded profile of the invention.

A stamping press can produce each one of said cuts.

Said sheet can correspond to a metal sheet, preferably steel.

The above-described invention involves a type of unfolding that permits saving of steel in the construction of constructive elements such as profiles and grids, among others, without prejudice to their structural performance; furthermore, their production costs are very competitive because they can involve industrialized production processes such as cold rolling, press stamping and unfolding.

BRIEF DESCRIPTION OF THE DRAWINGS

FIG. 4A includes non rotated elements (2.1), rotated elements (2.2), hardened regions (2.3), and close curves (2.4) according to the disclosed embodiments.

DETAILED DESCRIPTION OF THE INVENTION

Figure 1:
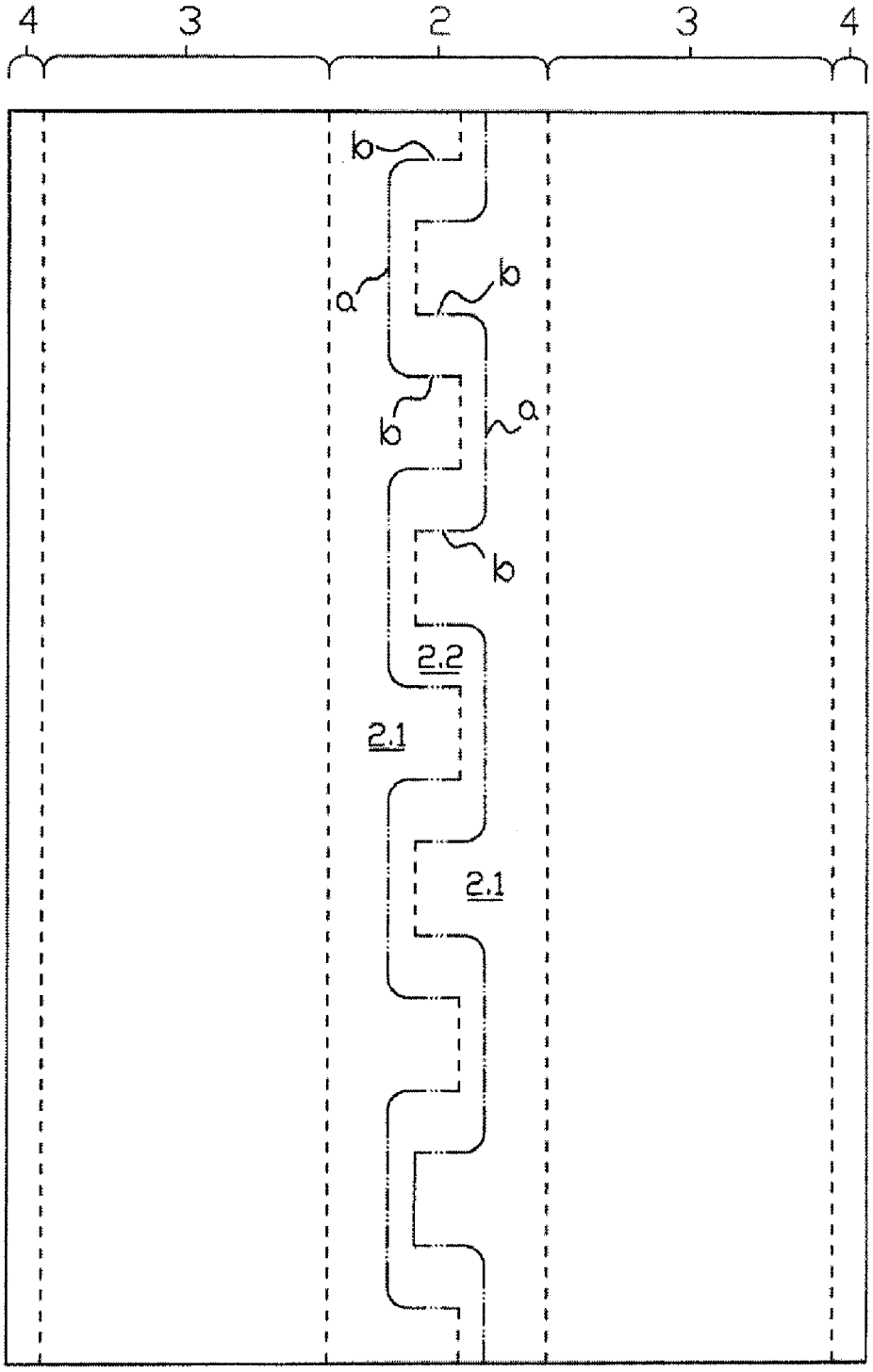
FIG. 1 shows a top view of a metal sheet, from which a metal profile (1) will be manufactured corresponding to the profile described in the preferred embodiment of this invention; the cuts have already been applied to said metal sheet prior to the step of rotational unfolding of the profile's core (2).
Figure 2:
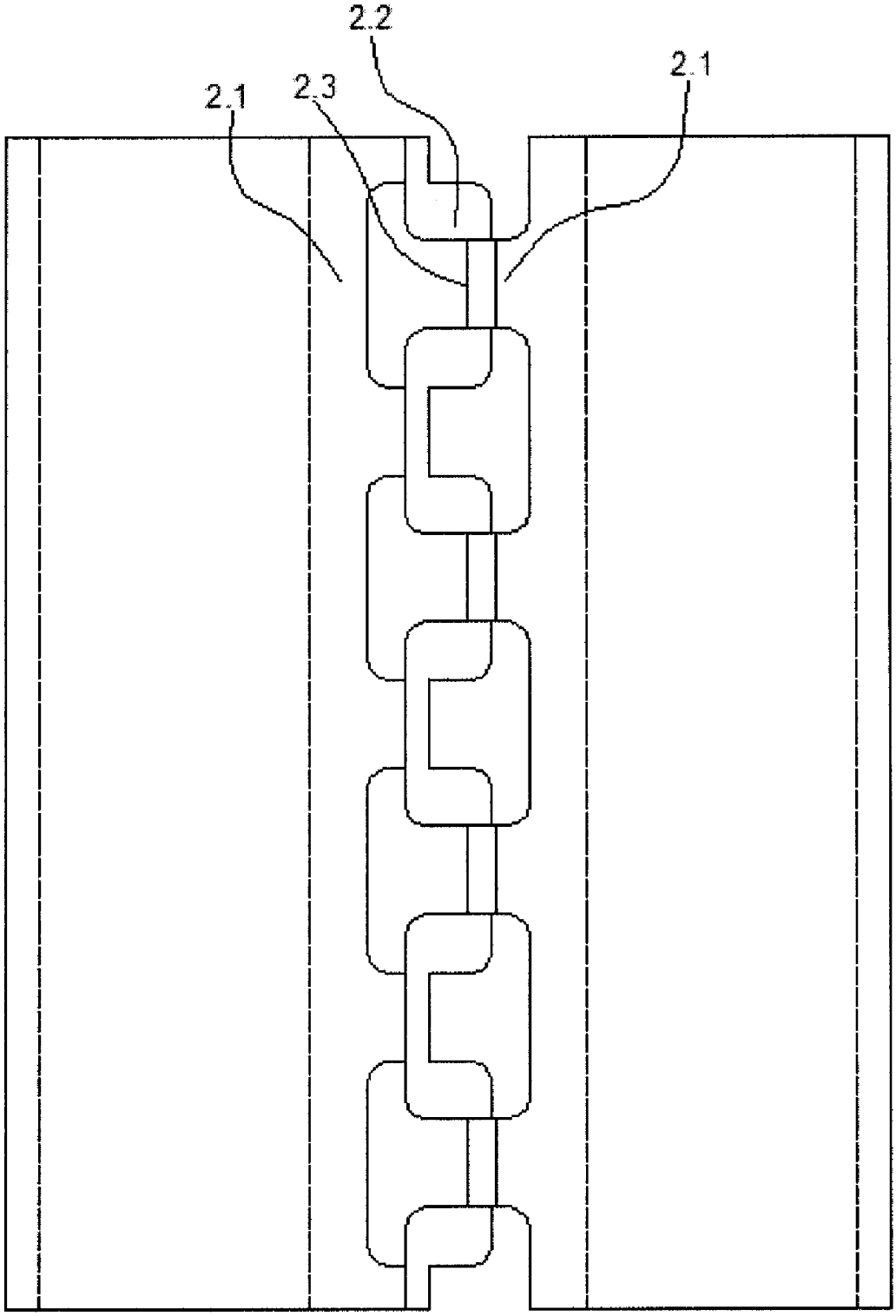
FIG. 2 shows a top view of the metal sheet shown in FIG. 1, in which the step of rotational unfolding of the profile's core (2) has already taken place.
Figure 3:
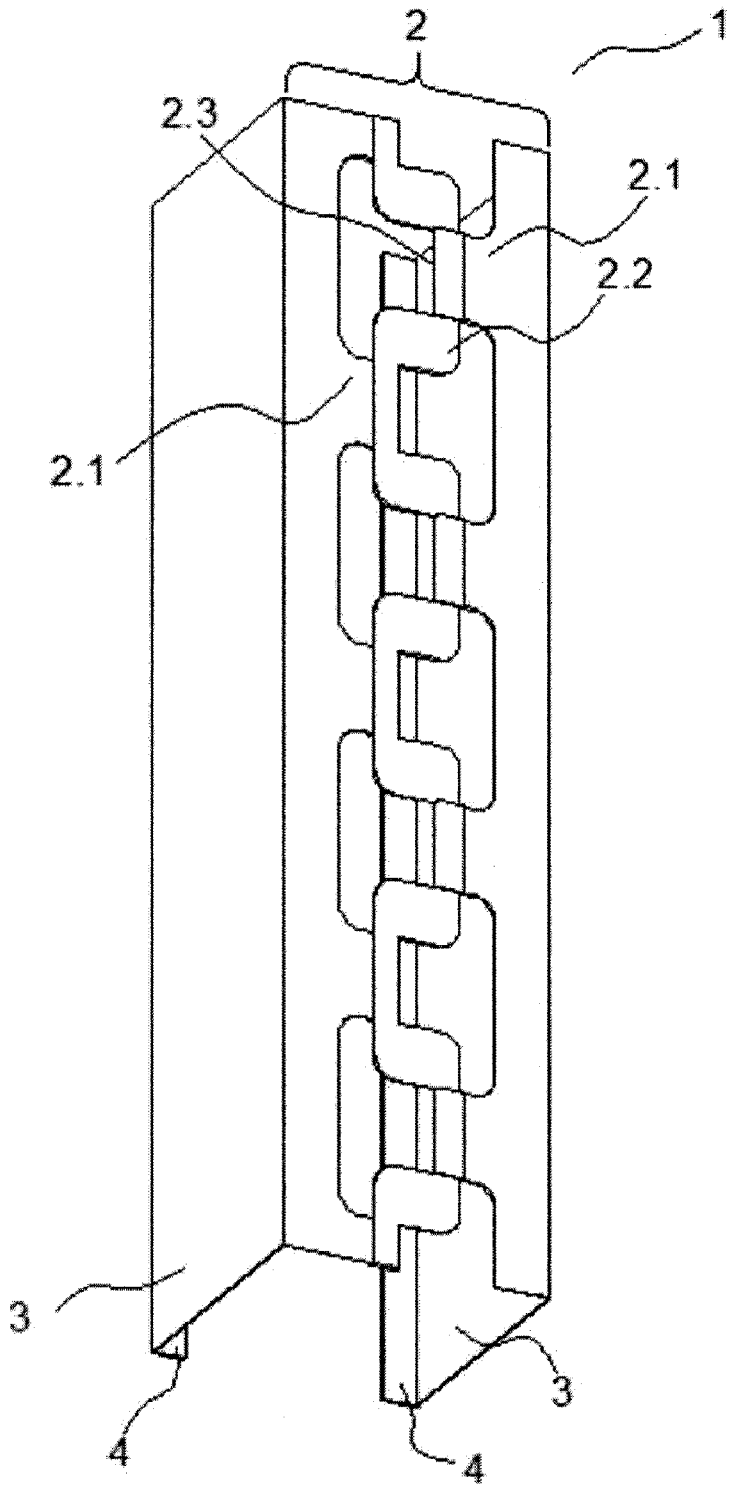
FIG. 3 shows a perspective view of the profile (1) described in the preferred modality of this invention. Said profile has been manufactured from the metal sheet shown in FIG. 1, where the step of rotational unfolding of the profile's core (2) has already taken place and where the step of shaping the wings (3) and flanges (4) of the profile has already taken place.
Figure 4:
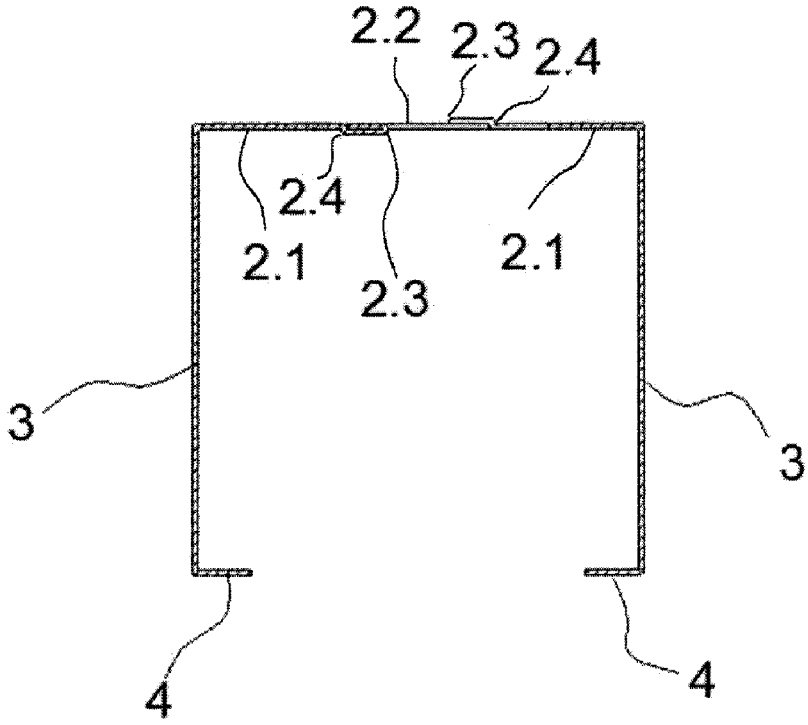
FIG. 4 shows a front view of the profile shown in FIG. 3, in which details can be appreciated of the closed curves associated to said at least one rotated element (2.2) and/or said at least one element that does not rotate (2.1).
Figure 4A:
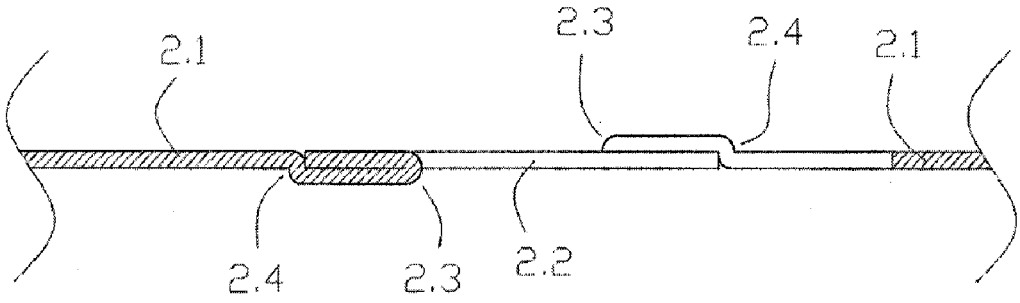
FIG. 4A shows a zoomed in view of the unfolded region (2) shown in FIG. 4.
Figure 5:
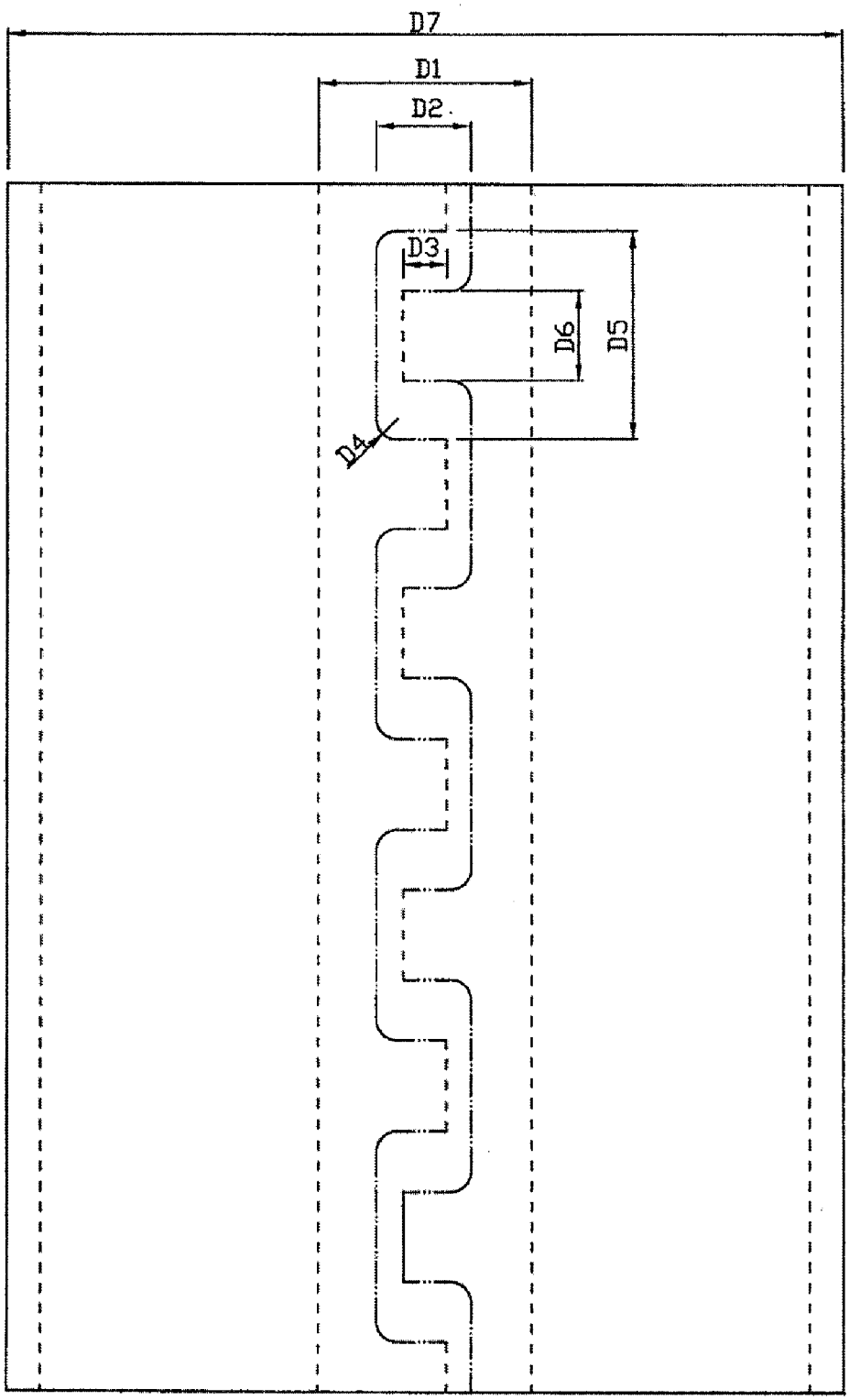
FIG. 5 shows a view similar to that shown in FIG. 1, where details can be appreciated of the optimized dimensions in the profile of the invention.

In its preferred modality, the invention corresponds to a structural or non structural profile (1) with a cross-section that is essentially constant, that is formed from a metal sheet having constant thickness; the cross-section of said structural or non structural profile (1) comprises an unfolded region (2) defined between two ends of said cross-section; said unfolded region (2) comprises a plurality of cuts that define a regular pattern along the entire length of the structural or non structural profile (1); said unfolded region (2) is produced when a tractional force is applied at its respective ends; said structural or non structural profile (1) is characterized because said unfolded region comprises at least one element rotated essentially in 180° (2.2) with regard to the rotation it had prior to the application of said tractional force; said at least one rotated element (2.2) is joined to at least one element that does not rotate (2.1), by means of conveniently defined linking lines (2.3).

Essentially, each one of those cuts, of said plurality of cuts, has the geometry of a "U" that comprises a base (a) and two sides (b), each one of which comprises a basal end, joined to said base (a), and a free end at a distance from said base; said plurality of cuts comprises two rows of cuts, each one of which is formed by a multiplicity of cuts placed one following the other in an adjacent manner; the bases (a) of each one of the cuts of each one of said rows of cuts are aligned; the free ends of the adjacent sides (b) of each pair of adjacent cuts of one of the rows of cuts are set out conveniently between the sides of a respective cut of the other row of cuts.

Each one of these bases (a) is essentially rectilinear and each one of said sides (b) is essentially rectilinear and forms an essentially right angle with the respective base (a) to which it is united.

The intersection between each one of said bases (a) and each one of said sides (b) is essentially curved.

Said structural or non structural profile (1) includes a cross-section essentially in the shape of a "U" that comprises a core that coincides with said unfolded region (2), and two wings (3) that extend outward from said core and finish in two respective free ends.

Said structural or non structural profile (1) includes two stiffener flanges (4) that spread out, coming closer to each other, from the free ends of said wings (3).

A stamping press produces each one of said cuts.

What is claimed is:

1. A sheet for forming a constructive element comprising:
a substantially rigid material having a plurality of cuts and folds on the sheet;
wherein the material separates along the cuts and folds along the folds forming at least one
closed curve,
overlapping zone,
non-rotated element, and
rotated element; and
wherein the closed curve connects said overlapping zone with said non-rotated element, and
the closed curve is shaped to align the rotated element and non-rotated element in a substantially coplanar and end-to-end relation.

2. The sheet of claim 1 wherein the rotated element rotates 180° with respect to the non-rotated element.

3. The sheet of claim 2 wherein the overlapping zone and the rotated element align in a substantially parallel relation.

4. The sheet of claim 1 wherein the material is comprised of metal, plastic, or composite.

5. The sheet of claim 1 wherein the cuts are made by a stamping press.

6. An apparatus for building comprising:
an expanded support member formed from a substantially rigid sheet of material having a plurality of cuts and folds;
wherein the support member is separated along the cuts and folded along the folds in response to tractional force applied on the support member;
a rotated element and a non-rotated element formed on said support member, each of said elements defined by at least one of the plurality of cuts and folds;
wherein the rotated element is rotated approximately 180 degrees with respect to the non-rotated element; and
a closed curve defining at least one of the folds on the support member;
wherein the closed curve is shaped to align the rotated element and non-rotated element in a substantially coplanar and end-to-end relation.

7. The apparatus of claim 6 wherein the closed curve forms a mutual interlocking between the rotated element and the non-rotated element.

8. The apparatus of claim 7 wherein the closed curve is shaped to position a resistance received from the non-rotated element onto the rotated element.

9. The apparatus of claim 8 wherein the closed curve is shaped to distribute the received resistance away from the overlapping zone.

10. The apparatus of claim 9 wherein the overlapping zone and the rotated element are in substantially parallel contact with one another.

11. A system for forming a constructive element comprising:

a support member formed from a substantially rigid sheet of material;

wherein the support member includes a plurality of cuts and folds; and wherein the support member is separated along the cuts and folded along the folds;

a first non-rotated element and a second non-rotated element formed on said support member, each of said elements defined by at least one of the plurality of cuts and folds; and a rotated element formed on said support member between the first non-rotated element and second non-rotated element, said rotated element formed by at least one of the plurality of cuts and folds;

wherein the rotated element is rotated with respect to the first and second non-rotated elements to form a substantially coplanar and end-to-end alignment between said rotated element, said first non-rotated element and said second non-rotated element.

12. The system of claim 11 further comprising a closed curve defined by at least one of the cuts and folds; wherein the closed curve forms a mutual interlocking about the end of the rotated element to distribute force end-to-end through the non-rotated elements and rotated element.

13. The system of claim 12 wherein the support member is further shaped to include at least one wing connected to the first or second non-rotated elements; wherein said wing is folded approximately 90 degrees with respect to said non-rotated element to provide structural support for said support member.

14. The system of claim 13 wherein the support member is further shaped to include at least one flange connected to the wing; wherein said flange is folded approximately 90° with respect to said wing and is essentially parallel to said non-rotated element to provide structural support for said support member.

* * * * *